US005212850A

United States Patent [19]

Rerolle

[11] Patent Number: 5,212,850

[45] Date of Patent: May 25, 1993

[54] DEVICE FOR HOLDING SEVERAL LEAVES TOGETHER

[75] Inventor: Nathalie Rerolle, Paris, France

[73] Assignee: In The Pocket, Lyons

[21] Appl. No.: 791,030

[22] Filed: Nov. 12, 1991

[30] Foreign Application Priority Data

Nov. 12, 1990 [FR] France ..... 90 13998

[51] Int. Cl.[5] ..... B42F 1/12

[52] U.S. Cl. ..... 24/67 AR; 24/67 CF; 24/543

[58] Field of Search ..... 24/67 CF, 67 R, 67 AR, 24/67.9, 67.11, 578, 543, 304, 487; 40/159.1

[56] References Cited

U.S. PATENT DOCUMENTS 2,728,451 12/1955 Leander ..... 24/67 AR X
2,796,646 6/1957 Redka ..... 24/518 X
2,843,901 7/1958 Bukowski ..... 24/67 CF
3,526,935 9/1970 Boyce et al. ..... 24/67.9
3,604,067 9/1971 Brown ..... 24/67 R

FOREIGN PATENT DOCUMENTS 10425 of 1915 United Kingdom ..... 24/518
2227047 7/1990 United Kingdom .

*Primary Examiner*—James R. Brittain
*Attorney, Agent, or Firm*—Brumbaugh, Graves, Donohue & Raymond

[57] ABSTRACT

A device for holding a file of leaves, made of a single piece of resilient material, comprises a flat upper element, a flat lower element, and a hinge-forming part between the upper and lower elements. The upper and lower elements have interlocking components cooperating with each other elastically and removably. The device will grip the file at a corner only. One or both of the upper and lower elements may have on its inner face a non-slip zone facing the upper or/and the lower leaf of the file.

11 Claims, 2 Drawing Sheets

DEVICE FOR HOLDING SEVERAL LEAVES TOGETHER

Figure 1:
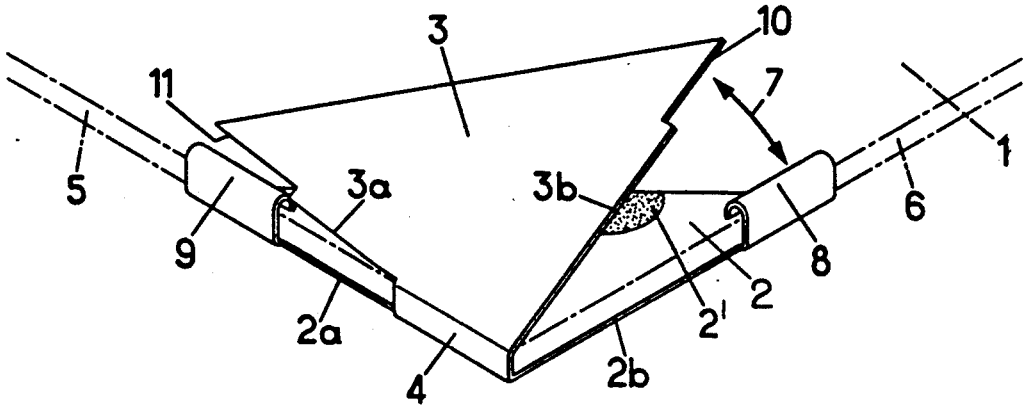

This invention relates to a device for holding several leaves forming a file.

It is usual to bind a certain number of leaves together forming a file consituting a document. The fastening means most often used in order to hold together a limited number of thin leaves currently consist of staples, metal corners, clips or fastenars.

Such conventional fastening means cause either a local deformation of the leaves of the file, or perforations in the leaves. Consequently, the conventional fasteners are not entirely satisfactory as regards the quality of the bound document, since they directly impair, to a greater or lesser extent, the quality and presentation of the leaves of the document.

Furthermore, conventional fasteners are mainly constructed using a metal material. In the case of letters, the presence of metal fasteners may constitute a source of disturbance to the operation of the electronic machines used in the postal services particularly for sorting of the post.

From U.K. Pat. Application No. 2 227 047 a metal or plastic fastener for leaves is known in the form of a clip. The two parts of the clip are connected to one another by a hinge. The placing of the clip onto the file of leaves necessitates a fold in the plane of the file so as to permit insertion on one side of one part of the clip into a lip for locking of the other part. The elastic deformation of the clip when it is fitted into place may well create a movement of slippage between the leaves of the file thus preventing a regular file from being obtained.

This invention relates to a holding device or a fastener for several leaves forming a file, which causes little or no impairment of the quality and presentation of the bound leaves.

Another object of the invention is to provide a fastener which can be constructed of resilient plastic material with a view to replacing the conventional metal fasteners for letters for example.

Another object of the invention is to propose a fastener which offers a surface serving as support for designs or text in order to personalise the bound documents or in particular to spread advertising messages.

The holding device or fastener for several leaves forming a file, according to the invention, is constructed from a rigid material and comprises:

- a flat upper element, the inner face of which is adapted to press against the first leaf of the file,
- a flat lower element, the inner face of which is adapted to press against the last leaf of the file,
- a hinge-forming part between the upper and lower elements and arranged along a first side of the upper element and along a first side of the lower element, said first sides being parallel with a first side of the file of the leaves;
- a primary resilient interlocking component on the inner face and along a second side of the upper element, said second side being parallel with a side contiguous to the first side of the file,
- a secondary resilient interlocking component on the inner face along a second side of the lower element corresponding to the second side of the upper element, said primary and secondary resilient interlocking components co-operating with one another removably so as to hold the upper and lower elements in assembled position, gripping and locking the leaves of the file.

According to one embodiment of the invention, the hinge-forming part is integral with the upper and lower elements and constitutes a bending zone between the upper element and the lower element.

On the side where the hinge-forming part is located, the upper and lower elements may comprise other resilient interlocking components, so as to be able to exert on the leaves of the file a pressure distributed in balanced manner over the inner faces of the upper and lower elements respectively.

Preferably, in order to avoid slippage of the first leaf and of the last leaf with respect to the upper and lower elements of the device in assembled position, at least one inner face of said upper and lower elements is advantageously rendered non-slip. For example, a roughened surface or a surface rendered slightly adhesive, or else an additional layer in easily deformable material such as a synthetic foam or a spongy substance may be provided.

The deformable additional layer on the inner face of at least one of the upper and lower elements offers the possibility of improving the holding of files of different thicknesses. The deformable additional layer may be of small size compared with the inner face of the corresponding element. Indeed, it is sufficient to have one or more spots of deformable material which are securely attached to the inner face of the corresponding element and which project from said inner face.

In order to avoid slippage of the leaves, the inner faces of the upper and lower elements may present reliefs of complementary shape, for example corrugations, projections and hollows, so that the leaves can be locked by gripping of the upper and lower elements of the device.

The device of the invention is preferably constructed in a single piece from a resilient synthetic material. Any other resilient material, for example metallic materials, may be used for the device of the invention.

Preferably, the upper and lower elements of the device of the invention are thin enough not substantially to increase the overall thickness of the bound file while retaining the required mechanical properties.

Figure 2:
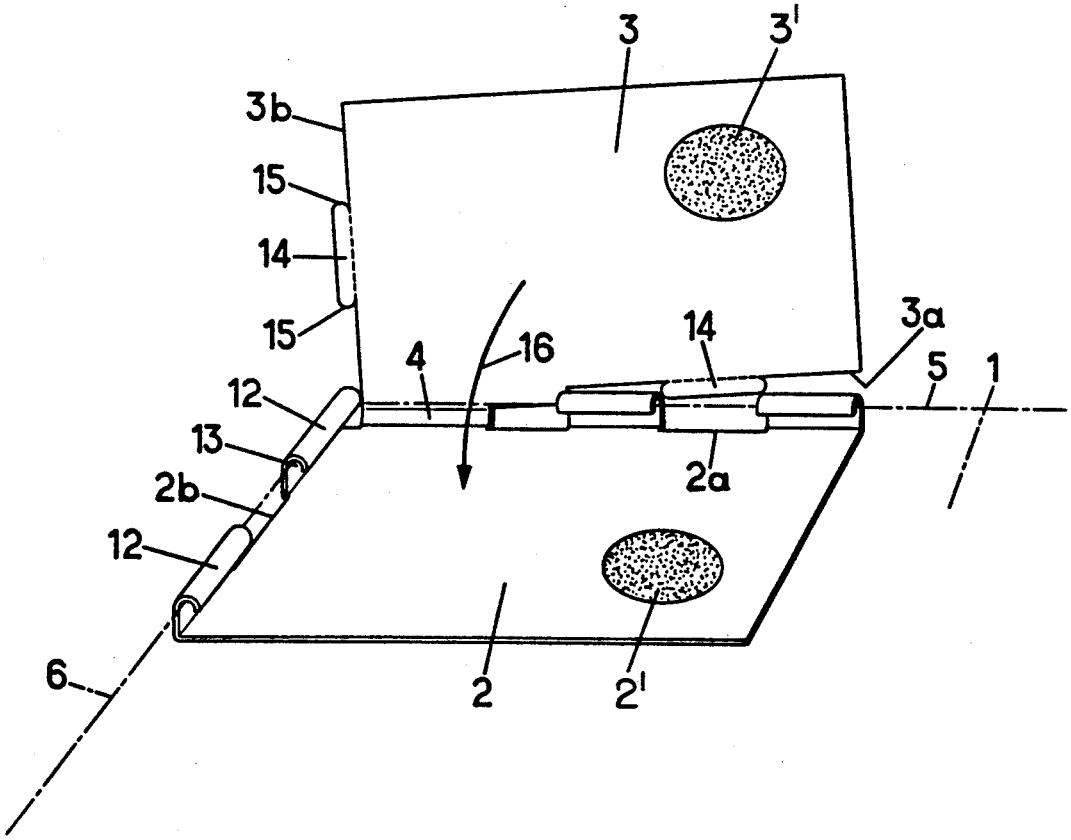
Figure 3:
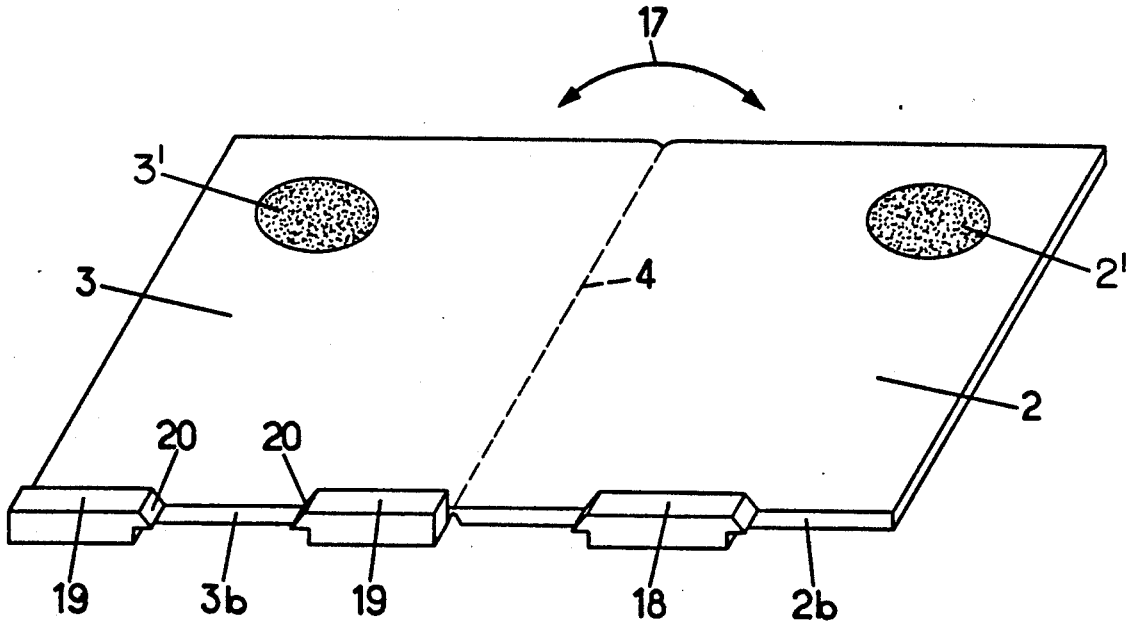

The invention will be better understood through study of the detailed description of three embodiments of the invention taken as by no means exhaustive examples and shown in the drawings, in which:

FIG. 1 is a diagrammatic perspective view of the device according to a first embodiment of the invention, FIG. 2 is a diagrammatic perspective view of the device according to a second embodiment of the invention, and FIG. 3 is a diagrammatic perspective view of the device according to a third embodiment of the invention.

In the FIGURES, the device of the invention is shown from particular angles with the aim of showing its structure more clearly. This is why FIGS. 1 and 2 show a file of leaves, the last leaf of which is found at the top of the file. In other words, the assembly formed by the file and the device is turned through 180° from the normal position.

According to a first embodiment of the invention shown in FIG. 1, the holding device for several leaves forming a file 1 comprises a flat upper element 2, a flat lower element 3, a bending zone 4 forming a hinge between the upper element 2 and lower element 3.

The upper element 2 and lower element 3 of the device each present a substantially triangular shape, the sizes of which are comparable with one another. The hinge 4 is located in the vicinity of an angle of the upper and lower elements 2, 3. The file of leases 1 presents a corner constituted by a first side 5 and a second side 6 forming a right angle with respect to one another. The triangular shape of the upper and lower elements 2, 3 presents two sides 2a, 3a and 2b, 3b substantially parallel with the sides 5 and 6 respectively of the file 1 forming the corner. Thus, the device of the invention enables the file 1 to be held while taking the exact shape of the corner of the file without creating appreciable projections on the sides.

The hinge 4 is located in the vicinity of the angle of the corner. The lower element 3 can be open or closed as indicated by the arrow 7 with respect to the upper element 2 by means of the hinge 4. The upper element 2 presents two resilient interlocking components 8, 9 along the sides 2b and 2a respectively and in the vicinity of the angles of the triangle other than that close to the hinge 4. The components 8, 9 project perpendicularly to the inner face of the upper element 2.

Preferably, the components 8, 9 present a convex cylindrical surface towards the inside of the upper element 2. The convex cylindrical surface stops at a height predetermined with respect to the inner face of the upper element 2 so as to be able to accommodate the sides 5 and 6 of the file of leaves in their thickness.

In the sides 3a and 3b of the lower element 3 are made two cutaways 10 and 11 constituting resilient interlocking components and adapted to co-operate with the convex cylindrical surfaces of the resilient interlocking components 8 and 9 of the upper element 2.

When one presses on the outer faces of the upper element 2 and of the lower element 3, using two fingers of one hand for example, the lower element 3 is brought towards the upper element 2 by pivoting by means of the hinge 4. The cutaways 10 and 11 of the lower element 3 encounter the convex cylindrical surfaces of the components 8 and 9 of the upper element 2 and, with the help of the pressure exerted and of resilient deformation, move past said convex cylindrical surfaces so as to be gripped by said convex cylindrical surfaces of the resilient interlocking components 8 and 9. Thus, the lower element 3 is held flat against the last leaf of the file 1 and participates in the holding of the leaves of the file with the upper element 2.

It is also possible to provide the interlocking components 8, 9, 10 and 11 in the form of projections and depressions in a manner similar to press-studs.

The file 1 of leaves held captive by the upper element 2 and lower element 3 may have a thickness varying between two and about ten or twenty leaves to be effectively held. Preferably, the inner face of the upper element 2 and/or the inner face of the lower element 3, adapted to be in contact with the file preferably present separate or interconnected zones 2', 3' rendered non-slip with respect to the leaves. These non-slip zones 2', 3' may have a greater roughness than the rest of the upper element 2 and lower element 3, or may be covered with a slightly adhesive layer so that the corresponding element 2 or 3 of the file 1 can be unstuck without leaving any trace on the corresponding leaf of the file.

It is also possible to form said non-slip zones 2', 3' by means of a spongy and flexible substance in plastic material, such as a synthetic foam, securely attached to the inner face of the corresponding element 2 or 3, so that the compression force for holding the leaves of the file 1, exerted by the upper element 2 and lower element 3 in assembled position, does not vary substantially for different thicknesses of the file 1. This therefore permits very effective holding of the leaves.

Other embodiments of the invention may be envisaged. For example, with respect to the embodiment shown in FIG. 1, the resilient interlocking components 9, 11 of the upper and lower elements 2, 3 may be replaced by a second hinge connecting the upper side 2a and lower side 3a in the same manner and on the same side as the hinge 4. This second hinge may also be integral with the hinge 4 so as to constitute a continuous side for bending between the upper element 2 and lower element 3.

Preferably, the bending zone 4 may be rendered more flexible in the direction of bending, for example by means of longitudinal grooves made in the bending zone or by making the depth of said zone thinner compared with the upper and lower elements 2, 3.

It is also possible to envisage the upper and lower elements 2, 3 in a shape different from the triangular shape without affecting the operation of the device. Another possibility is the elimination of the corner where the hinge 4 is located in FIG. 1. In this manner, the device then comprises the upper and lower elements 2, 3 in the form of a trapezium. A bending zone 4 would then still have to be provided on the side 2a, 3a, but in the zone where the interlocking components 9, 11 are found in FIG. 1.

FIG. 2 shows another embodiment of the invention with the upper element 2 and lower element 3 flat and substantially rectangular and connected to one another by means of a bending zone 4 along one side 2a, 3a of the rectangles. The resilient means used for assembly of the upper and lower elements 2, 3 are slightly different from those used in the embodiment shown in FIG. 1.

On the first side 2b of the upper element 2 parallel with the side 6 of the file 1, the upper element 2 presents two longitudinal lips 12 projecting towards its inner face. The facing ends of the lips 12 each present a depression 13.

The corresponding side 3b of the lower element 3 presents a form complementary to the side 2b of the upper element 2. The side 3b comprises a longitudinal protuberance 14, the two ends 15 of which are convex and rounded, so that the turning back of the lower element 3 by means of the hinge 4 and in the direction of the arrow 16 causes a slight resilient deformation of the ends 15 of the longitudinal protuberance 14 and of the facing ends of the lips 12. With the device in assembled position, the rounded convex ends 15 of the longitudinal protuberance 14 of the lower element 3 are accommodated in the depressions 13 of the facing ends of the lips 12 of the upper element 2. The same resilient interlocking means may be used for the sides 2a, 3a of the upper and lower elements 2, 3 in the extension of the bending zone 4 parallel with the side 5 of the file 1.

As for the first embodiment shown in FIG. 1, at least one of the upper and lower elements 2, 3 presents on its inner face non-slip zones 2', 3' in order to hold the leaves of the file 1 in place.

In the embodiment shown in FIG. 3, the device comprises a hinge 4 extending along the entire length of the side 2a, 3a of the upper and lower elements. Otherwise, this embodiment is comparable with that shown in FIG. 2.

In FIG. 3, the device of the invention is in open position with the upper element 2 and lower element 3 substantially coplanar. The closure of the device is performed by pivoting along the hinge 4 as shown by the arrow 17. A primary resilient interlocking component 18 of trapezoidal shape co-operates with a secondary resilient interlocking component 19 delimiting a recess for the primary component 18, the entry into the recess being provided with inclined faces 20 so as to facilitate the insertion of the primary trapezoidal component 18 into the recess.

In all of the embodiments described above, the device of the invention is put into place simply by pressing on the two outer faces of the upper and lower elements 2, 3 without necessitating the resilient deformation of said elements; the resilient deformation takes place at the level of the interlocking components.

I claim:

1. A holding device for a plurality of leaves forming a file including a first leaf and a last leaf, comprising:

(a) an upper element having an inner face which is adapted to press against the first leaf only at a corner of the file to be held;

(b) a lower element having an inner face which is adapted to press against the last leaf only at the corner of the file to be held;

(c) a hinge-forming part between the upper and lower elements and arranged along a first side of the upper element and along a first side of the lower element, said first sides being parallel with a first side of the file of leaves;

(d) a primary resilient interlocking component on the inner face and along a second side of the upper element, parallel with a side contiguous to the first side of the file;

(e) a secondary resilient interlocking component on the inner face and along a second side of the lower element corresponding to the second side of the upper element, adapted to cooperate with the primary component by resilient interlocking in releasable manner, so as to hold the upper and lower elements in assembled position with said upper and lower elements exerting compression forces on the file and locating the leaves of the file, the upper and lower elements being flat, and the first and second sides of said upper and lower elements being shorter than the respective first and second sides of the file of leaves.

2. The device according to claim 1, further comprising non-slip means on at least one of the inner faces of the upper and lower elements, for inhibiting slippage between the at least one of the inner faces and the first-/last leaf.

3. The device according to claim 2, in which the non-slip means comprises oppositely corresponding first and second non-slip zones on the inner faces of the upper and lower elements.

4. The device according to claim 2, in which the non-slip means comprises a spongy material.

5. The device according to claim 2, in which the non-slip means has a non-slip surface with greater roughness than the remainder of the upper and lower elements.

6. The device according to claim 2, in which the non-slip means are slightly adhesive with respect to the leaves of the file.

7. The device according to claim 1 or 2, in which the primary resilient interlocking component comprises a longitudinal lip projecting and presenting a convex cylindrical surface towards the interior of the inner face of the upper element, and the secondary resilient interlocking component is adapted to co-operate with the convex cylindrical surface of the longitudinal lip by means of an elastic deformation for locking by said lip, thereby exerting a holding pressure on the file of leaves.

8. The device according to claim 1 or 2, in which the primary resilient interlocking component comprises two longitudinal lips having facing, ends of which each comprises a depression, and the secondary resilient interlocking component comprises a longitudinal protuberance having ends of rounded convex shape for cooperating resiliently with the depressions of the longitudinal lips, thereby locking the upper and lower elements.

9. The device according to claim 1 or 2, further comprising additional resilient interlocking components on the first sides of the upper and lower elements.

10. The device according to claim 1 or 2, in which the primary resilient interlocking component has trapezoidal shape and the secondary resilient interlocking component delimits a recess, the entry into which comprises inclined faces for facilitating insertion of the primary resilient interlocking component.

11. The device according to claim 1 or 2, made as one single piece of plastic material.

* * * * *